US010316625B2

(12) United States Patent
Garcia Zurita et al.

(10) Patent No.: US 10,316,625 B2
(45) Date of Patent: Jun. 11, 2019

(54) AUTOMATIC UPDATING OF WELL PRODUCTION MODELS

(71) Applicant: Schlumberger Technology Corporation, Sugar Land, TX (US)

(72) Inventors: Carlos Arturo Garcia Zurita, Pune (IN); Franz Fuehrer, Kjeller (NO); Riku Vilkki, Cypress, TX (US); Henry David Torres Rincon, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 526 days.

(21) Appl. No.: 14/848,394

(22) Filed: Sep. 9, 2015

(65) Prior Publication Data

US 2017/0067325 A1 Mar. 9, 2017

(51) Int. Cl.
*G06F 17/50* (2006.01)
*E21B 43/00* (2006.01)

(52) U.S. Cl.
CPC ..... *E21B 43/00* (2013.01)

(58) Field of Classification Search
USPC ..... 703/2, 13; 707/802
See application file for complete search history.

(56) References Cited

U.S. PATENT DOCUMENTS 6,053,947 A * 4/2000 Parson ..... G06F 17/5022 703/13
7,895,241 B2 * 2/2011 Schoen ..... G06F 17/30286 707/802
2007/0255499 A1 11/2007 Strack et al.
2008/0235280 A1 * 9/2008 Schoen ..... G06F 17/30286
2009/0198477 A1 8/2009 Benish et al.
2010/0023269 A1 1/2010 Yusti et al.
2012/0330634 A1 12/2012 Kmudo
2014/0278302 A1 9/2014 Ziegel et al.
2015/0066373 A1 3/2015 Al-Nahdi et al.

FOREIGN PATENT DOCUMENTS

WO 2004/049216 A1 6/2004
WO 2013/019546 A2 2/2013

OTHER PUBLICATIONS

Omole, et al., "Real-time Production Optimization in the Okume Complex Field, Offshore Equatorial Guinea," SPE Digital Energy Conference and Exhibition held in The Woodlands, TX, USA, Apr. 19-21, 2011.

(Continued)

*Primary Examiner* — Thai Q Phan
(74) *Attorney, Agent, or Firm* — Colin L. Wier

(57) ABSTRACT

Methods, computer-readable media, and computing systems for maintaining a well production model. The method includes receiving an update to a parameter of the model of a well, and updating the model based on the update. The method also includes splitting the model into at least two submodels after updating the model, and running the submodels to obtain results. The method further includes determining that the results obtained by running the submodels do not match, and in response to determining that the results obtained by running the submodels do not match, calibrating the model based on the update.

21 Claims, 6 Drawing Sheets

(56) References Cited

OTHER PUBLICATIONS

Rebeschini, et al., "Building Neural-Network-Based Models Using Nodal and Time-Series Analysis for Short-Term Production Forecasting," SPE Middle East Intelligent Eneregy Conference and Exhibition held in Dubai, Oct. 28-30, 2013.
International Search Report and Written Opinion for the equivalent International patent application PCT/US2016/049807 dated Dec. 15, 2016.
International Preliminary Report on Patentability for the equivalent International patent application PCT/US2016/049807 dated Mar. 22, 2018.
Extended Search Report for the equivalent European patent application 16844905.6 dated Apr. 5, 2019.

* cited by examiner

AUTOMATIC UPDATING OF WELL PRODUCTION MODELS

BACKGROUND

Well production models are used to design and evaluate well completions and artificial lift systems, as well as to diagnose well performance problems. This may facilitate enhanced well production by allowing for testing and selecting operating conditions. Building and maintaining such well production models, however, may be a time-intensive process. For example, when a user has obtained the inputs to the well production model, it may minutes to hours (or longer, depending on the skill of the user) to update and calibrate the model. Further, a user may be responsible for many wells, and thus the update time for the wells, in the aggregate, may extend to months.

Some well production modeling applications are able to update well production models with the latest measured data. However, these applications typically call for a dedicated staff to check if the model is still valid, in view of the updates, and upload a new model whenever the latest model does not match the operating conditions or any other changes that happen in the well.

SUMMARY

Embodiments of the disclosure may provide a method for maintaining a well production model. The method includes receiving an update to a parameter of the model of a well, and updating the model based on the update. The method also includes splitting the model into at least two submodels after updating the model, and running the submodels to obtain results. The method further includes determining that the results obtained by running the submodels do not match, and in response to determining that the results obtained by running the submodels do not match, calibrating the model based on the update.

In an embodiment, splitting the model includes splitting the model into a surface submodel and a combined vertical lift performance and inflow performance relationship submodel.

In an embodiment, splitting the model includes splitting the model into three submodels comprising a surface submodel, a vertical lift performance submodel, and an inflow performance relationship model.

In an embodiment, determining that the results obtained by running the submodels do not match includes identifying one of the three submodels that yields results that do not match results of the other two. In such embodiment, calibrating may include calibrating the one of the three models.

In an embodiment, splitting the model includes when a bottomhole pressure of the well is known, splitting the model into a surface submodel and a combined vertical lift performance and inflow performance relationship submodel, and when the bottomhole pressure of the well is unknown, splitting the model into a surface submodel, a vertical lift performance submodel, and an inflow performance relationship model.

In an embodiment, calibrating the model includes obtaining a well type, performing a root-finding process, the root-finding process, adjusting an adjusted property of the model, calculating a calculated value of the model based on the adjusted property, determining that the calculated value is within a predetermined tolerance of a target value, and determining that the calculated value differs from a previous calculated value by less than a predetermined tolerance.

In an embodiment, the update includes a change in a time-dependent variable, a change in an event-dependent variable, or both, and updating the model is in response to receiving the update.

Embodiments of the disclosure may also provide a computing system. The computing system includes one or more processors, and a memory system comprising one or more non-transitory computer-readable media storing instructions that, when executed by at least one of the one or more processors, cause the computing system to perform operations. The operations include receiving an update to a parameter of the model of a well, updating the model based on the update, splitting the model into at least two submodels after updating the model, running the submodels to obtain results, determining that the results obtained by running the submodels do not match, and, in response to determining that the results obtained by running the submodels do not match, calibrating the model based on the update.

Embodiments of the disclosure may also provide a non-transitory computer-readable media storing instructions that, when executed by at least one processor of a computing system, cause the computing system to perform operations. The operations include receiving an update to a parameter of the model of a well, updating the model based on the update, splitting the model into at least two submodels after updating the model, running the submodels to obtain results, determining that the results obtained by running the submodels do not match, and in response to determining that the results obtained by running the submodels do not match, calibrating the model based on the update.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both, objects or steps, respectively, but they are not to be considered the same object or step.

The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

Figure 1:
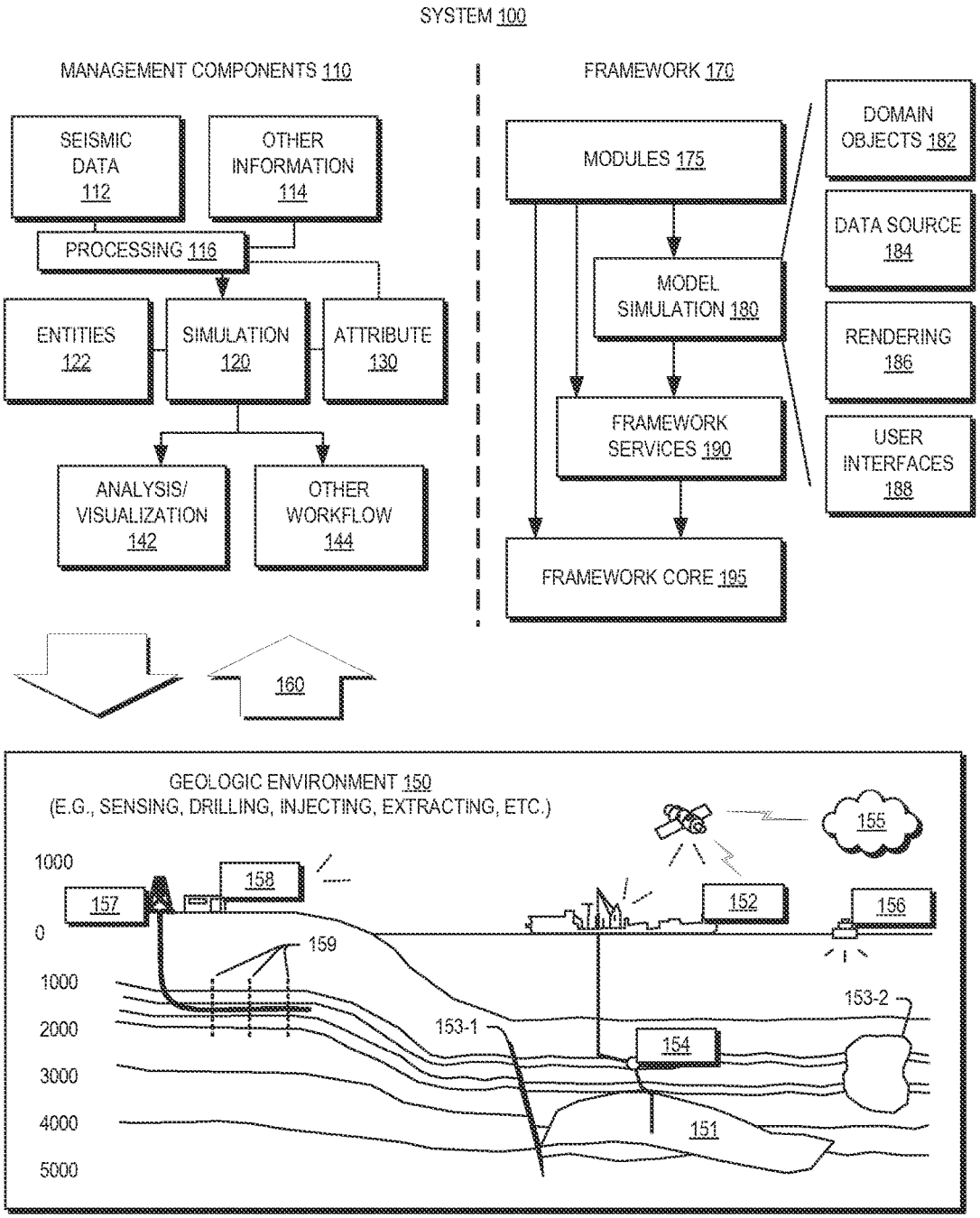
FIG. 1 illustrates an example of a system that includes various management components to manage various aspects of a geologic environment, according to an embodiment.

FIG. 1 illustrates a block diagram of an environment 10 for implementing methods and systems in accordance with aspects of the present disclosure. The environment 10 includes a geologic modeling and analysis system 100 and a geologic environment 149. The management components 110 can allow for direct or indirect management of sensing, drilling, injecting, extracting, etc., with respect to the geologic environment 149. The geologic environment 149 can include, for example, a sedimentary basin 150, a reservoir 151, one or more faults 153-1, one or more geobodies 153-2, and the like. The geologic modeling and analysis system 100 can obtain information about the geologic environment 149 can be obtained as feedback 160, which can be input to one or more of the management components 110.

In accordance with aspects of the present disclosure, the geologic modeling and analysis system 100 includes hardware and software that perform the processes and functions described herein. In embodiments, the geologic modeling and analysis system 100 includes a computing device 115 and a hardware data storage device 116. In embodiments, the computing device 130 includes one or more processors, one or more memory devices (e.g., RAM and ROM), one or more I/O interfaces, and one or more network interfaces. The memory devices can include a local memory (e.g., a random access memory and a cache memory) employed during execution of program instructions. The data storage device 116 can comprise a computer-readable, non-volatile hardware storage device that stores information and program instructions. For example, the data storage device 116 can be one or more flash drives and/or hard disk drives.

Using the processor, the computing device 115 executes computer program instructions (e.g., an operating system and/or application programs), which can be stored in the memory devices and/or data storage device 116. Moreover, in accordance with aspects of the present disclosure, the computing device 115 can execute computer program instructions of the management component 110 and the framework 170.

In accordance with aspects of the present disclosure, the management components 110 include a seismic data component 112, an additional information component 114 (e.g., well/logging data), the computing device 115, the data storage device 116, a simulation component 120, an attribute component 130, an analysis/visualization component 142 and a workflow component 144. In operation, seismic data and information provided per the seismic data component 112 and the additional information component 114 may be input to the simulation component 120 to, for example, model the geologic environment 149.

In accordance with aspects of the present disclosure, the simulation component 120 is software, hardware, or a combination thereof that, when executed by the computing device 115, causes that geologic modeling and analysis system 100 to model and/or simulate drilling operations in the geologic environment 149. In embodiments, the simulation component 120 can use entities 122, which can include earth entities or geological objects such as wells, surfaces, bodies, reservoirs, etc. In the geologic modeling and analysis system 100, the entities 122 can include virtual representations of actual physical entities of, for example, the geologic environment 149 that are reconstructed for purposes of simulation by the simulation component 120. The entities 122 can be determined based on data acquired via sensing, observation, etc. (e.g., the seismic data 112 and other information 114), which can be obtained from the geologic environment 149 via feedback 160. Each of the entities 122 can be characterized by one or more properties. For example, a fracture entity can be characterized by one or more properties such as location, size, shape, volume, orientation, pressure, porosity, fluid density, pore volume, etc. The properties can represent one or more measurements (e.g., data acquired from the geologic environment and reference data), calculations (e.g., determined based on the acquired data and the reference data), etc.

In an example embodiment, such as shown in FIG. 1, the simulation component 120 can operate in conjunction with a software framework, such as an object-based framework. In the object-based framework, some or all of the entities can be have pre-defined classes and sub-classes that facilitate modeling and simulation. A commercially available example of an object-based framework is the MICROSOFT®.NET® framework (Redmond, Wash.), which provides a set of extensible object classes. In the .NET® framework, an object class encapsulates a module of reusable code and associated data structures. Object classes can be used to instantiate object instances for use in a program, script, etc. For example, borehole classes may define objects for representing boreholes based on well data.

In embodiments, such as the example of FIG. 1, the simulation component 120 can process information to conform to one or more attributes specified by the attribute component 130, which may include a library of attributes.

Such processing may occur prior to input to the simulation component 120 (e.g., consider the computing device 115). As an example, the simulation component 120 may perform operations on input information based on one or more attributes specified by the attribute component 130. In an example embodiment, the simulation component 120 can construct one or more models of the geologic environment 149, which can be relied on to simulate behavior of the geologic environment 149 (e.g., responsive to one or more acts, whether natural or artificial, such as drilling a well).

In embodiments, such as the example of FIG. 1, the analysis/visualization component 142 allows for interaction with a model or model-based results (e.g., simulation results, etc.). For example, the output of the simulation may be presented using an interactive graphical user interface. Further, outputs from the simulation component 120 may be input to one or more other workflows, as indicated by a workflow component 144. For example, in accordance with aspects of the present disclosure, the simulation component 115 can exchange information with a rig selection module to query a commercial rig database, select available rigs, and model the operation of the rigs based on their respective technical capabilities.

In embodiments, the simulation component 120 can include one or more features of a simulator such as the ECLIPSE™ reservoir simulator (Schlumberger Limited, Houston Tex.), the INTERSECT™ reservoir simulator (Schlumberger Limited, Houston Tex.), a PETREL® drilling simulator (Schlumberger Limited, Houston Tex.), etc. As an example, a simulation component, a simulator, etc. can include features to implement one or more grid-less techniques (e.g., to solve one or more equations, etc.). As an example, a reservoir or reservoirs may be simulated with respect to one or more enhanced recovery techniques (e.g., consider a thermal process such as SAGD, etc.).

In embodiments, the management components 110 can include features of a commercially available framework such as the PETREL® seismic to simulation software framework (Schlumberger Limited, Houston, Tex.). The PETREL® framework provides components that allow for optimization of exploration, planning, and development operations. The PETREL® framework includes seismic to simulation software components that can output information for use in increasing reservoir performance, for example, by improving asset team productivity. Additionally, the PETREL® framework includes a drilling simulator that enables the display drilling of events in 2D or 3D, and correlates the events with geological properties of the reservoir.

Through use of such a framework, one or more analysts (e.g., geophysicists, geologists, and reservoir engineers) can develop collaborative workflows and integrate operations to streamline processes. Such a framework can be considered an application and can be considered a data-driven application (e.g., where data is input for purposes of modeling, simulating, etc.).

In embodiments, various aspects of the management components 110 may include add-ons or plug-ins that operate according to specifications of a framework environment. For example, a commercially available framework environment marketed as the OCEAN® framework environment (Schlumberger Limited, Houston, Tex.) allows for integration of add-ons (or plug-ins) into a PETREL® framework workflow. The OCEAN® framework environment leverages .NET® tools (Microsoft Corporation, Redmond, Wash.) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially available OCEAN® framework where the model simulation layer 180 is the commercially available PETREL® model-centric software package that hosts OCEAN® framework applications. In an example embodiment, the PETREL® software may be considered a data-driven application. The PETREL® software can include a framework for model building and visualization.

In accordance with aspects of the present disclosure, the framework 170 includes features for implementing one or more grid generation techniques. In embodiments, the framework 170 can include an input component for receipt of information from interpretation of the seismic data, the attributes 130, as well as, for example, log data, image data, etc. Such a framework may include a grid generation component that processes input information, optionally in conjunction with other information, to generate a grid representing three-dimensional divisions of the geologic environment 149.

In embodiments, such as shown in the example of FIG. 1, the model simulation layer 180 may provide domain objects 182, act as a data source 184, provide for rendering 186, and provide for various user interfaces 188. Rendering 186 may provide a graphical environment in which applications can display their data while the user interfaces 188 may provide a common look and feel for application user interface components.

As an example, the domain objects 182 can include entity objects, property objects and optionally other objects. Entity objects may be used to geometrically represent wells, surfaces, bodies, reservoirs, fractures, etc., while property objects may be used to provide property values as well as data versions and display parameters. An entity object may represent a fracture in the reservoir where a property object provides log information as well as version information and display information (e.g., to display the well as part of a model).

In the example of FIG. 1, the sedimentary basin 150 may have layers (e.g., stratification) that include a reservoir 151 and one or more other features such as the fault 153-1, the geobody 153-2, etc. As an example, the geologic environment 149 may be outfitted with any of a variety of sensors, detectors, actuators, etc. in the sedimentary basin 150. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a well site and include sensing, detecting, emitting, or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally include circuitry for imagery (e.g., spatial, spectral, temporal, radiometric, etc.).

In embodiments, such as shown in FIG. 1, the geologic environment 149 can include equipment 157 and 158 associated with a well that includes a substantially horizontal portion that may intersect with the fractures 159. For example, the sedimentary basin 150 can be a shale formation and the fractures 159 can include natural fractures, artificial fractures (e.g., hydraulic fractures) or a combination of natural and artificial fractures in the shale formation. As an example, a well may be drilled for reservoir 151 that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of the fractures 159, etc.

In accordance with aspects of the present disclosure, the geologic modeling and analysis system 100 can be used to perform one or more workflows, such as workflow 144. Workflow 144 may be a process that includes a number of worksteps. A workstep may operate on data, for example, to create new data, to update existing data, etc. As an example, a workstep may operate on one or more inputs and create one or more results, for example, based on one or more algorithms. As an example, the management components 110 can include a workflow editor for creation, editing, executing, etc. of the workflow 144. In such an example, the workflow editor may provide for selection of one or more pre-defined worksteps, one or more customized worksteps, etc. As an example, the workflow 144 may be a workflow implementable in the PETREL® software, for example, that operates on seismic data, seismic attribute(s), etc. As an example, the workflow 144 may be a process implementable in the OCEAN® framework. As an example, the workflow 144 may include one or more worksteps that access a module such as a plug-in (e.g., external executable code, etc.). In accordance with aspects of the invention, the workflow implements a drilling simulation, which can be implemented in, the PETREL® software.

Figure 2:
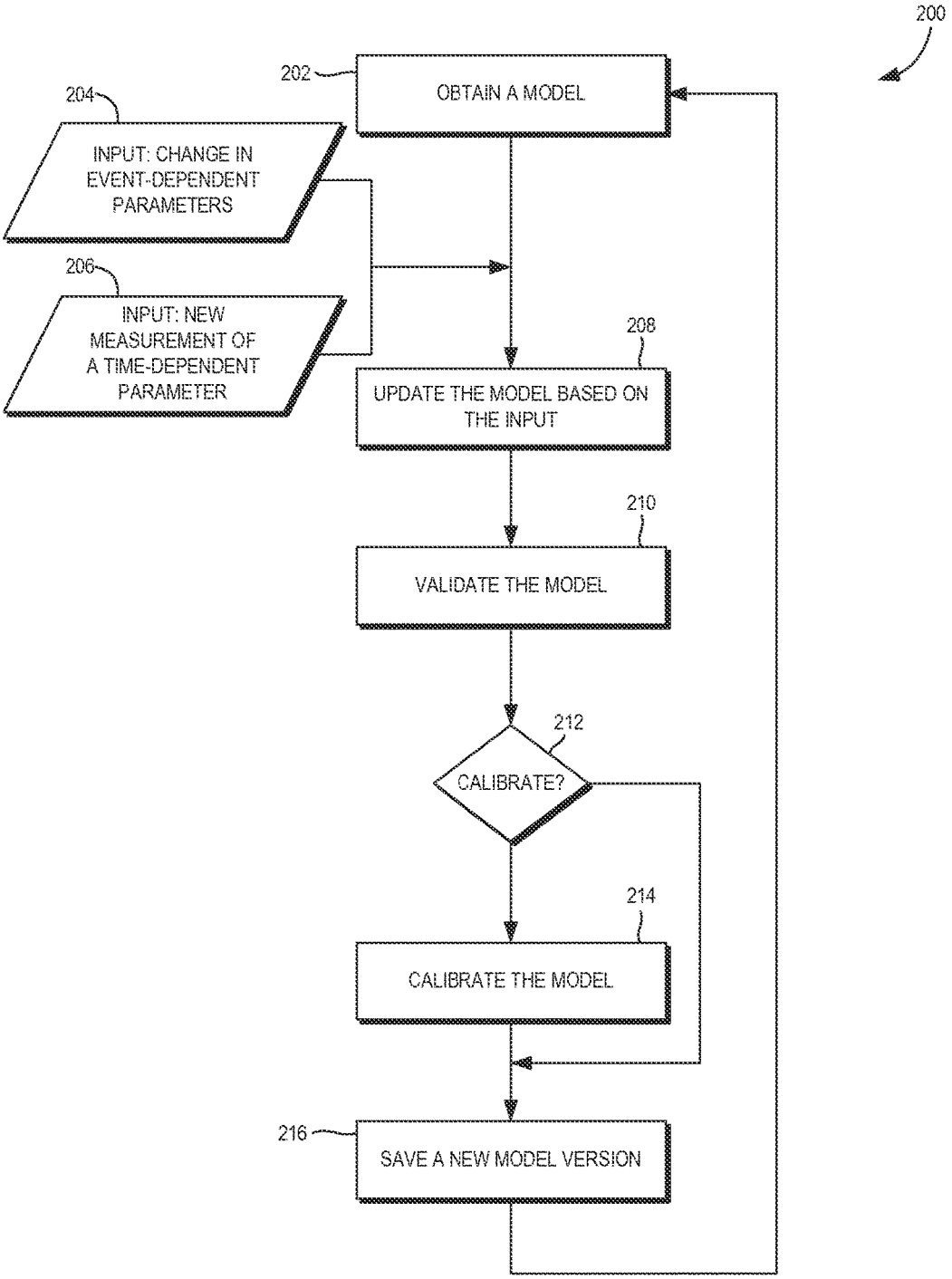
FIG. 2 illustrates a flowchart of a method for maintaining a well production model, according to an embodiment.

FIG. 2 illustrates a flowchart of a method 200 for maintaining a well production model, according to an embodiment. The method 200 may, in some embodiments, employ time-stamped models, and potentially many (e.g., tens, hundreds, etc.) of models may be maintained simultaneously using the present method 200. For at least some of the models, the last-in-time model may be employed until a new model, with a later time-stamp, replaces it.

The method 200 may begin by obtaining the well production model, as at 202. The well production model may be a digital representation of a well, including completion equipment, artificial lift systems, formation properties, etc. Thus, the model may, in some embodiments, be a representation of a concrete, physical system. Further, once calibrated or otherwise updated, e.g., using an embodiment of the method 200 disclosed herein, the model 200 may be employed to adjust physical parameters of the well and/or may be displayed visually to a user.

The method 200 may also include receiving input. The input may include changes in event-dependent parameters, as indicated at 204 and/or new measurements of well production rate and/or other time-dependent parameters, as at 206, and/or any other new data that is relevant to the well production model. Such measurements may be acquired using flow meters, pressure sensors, or other similar devices whether positioned in the well or on the surface. For example, time-dependent variables may include tubing head pressure, choke, reservoir pressure, and the like. These variables may have a frequency of change of seconds, minutes, hours, days, months, or even years. Event-dependent variables may change sporadically during the life of the model, as they may, in some cases (but potentially not all cases) change in response to the occurrence of an event. Such parameters include flow correlations, workovers in which wellbore equipment is changed, pressure, volume, and temperature (PVT) correlation models, etc.

Figure 3:
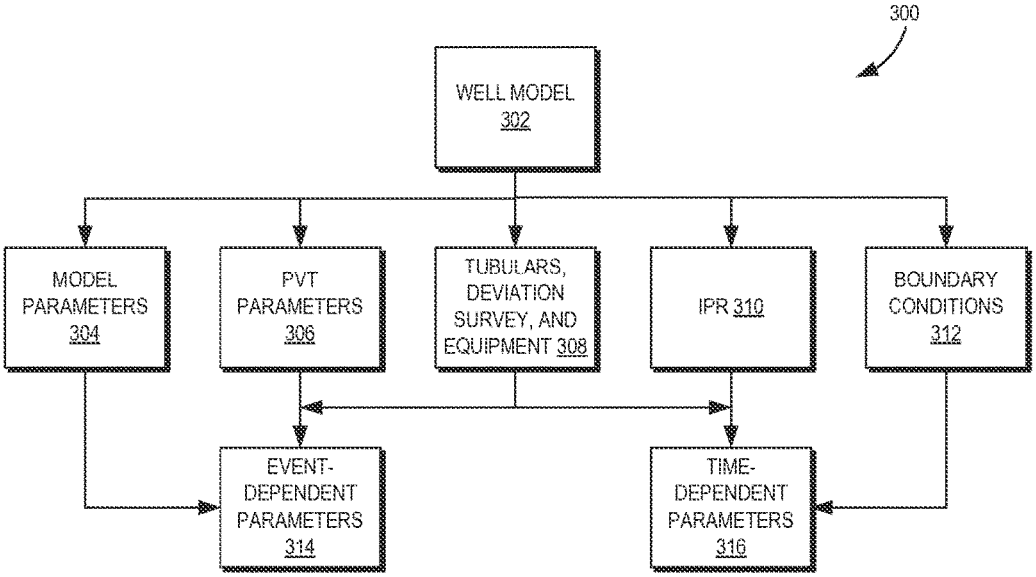
FIG. 3 illustrates a block diagram of a classification of well model parameters, according to an embodiment.

FIG. 3 illustrates a block diagram of such a well model 302, according to an embodiment. As shown, the well model 302 may include several different components. The first may be model parameters 304, such as flow correlation factors, heat transfer, etc. Another component may be PVT parameters 306, such as a correlation, gas oil ratio, water cut, specific gravities, water emulsions, etc. Another component may be related to the physical equipment and well trajectory, and may include tubulars, deviation survey, and equipment 308. Further components may also include inflow performance relationship (IPR) parameters 310, and boundary conditions 312. Those components that vary with time, e.g., according to a measurement sampling frequency or the like, may be time-dependent 314, as noted above. Other parameters that change sporadically during the life of the well model 302 may be considered event driven parameters 316, as also noted above.

Referring back to FIG. 2, in some embodiments, the reception of such input my serve as a trigger to proceed in the method 200 (e.g., as an interrupt), but in other embodiments, the method 200 may proceed upon expiration of a duration of time or based on any other trigger, whether or not related to input. Having received the input, the method 200 may include updating the model based on the input, as at 208.

Figure 4:
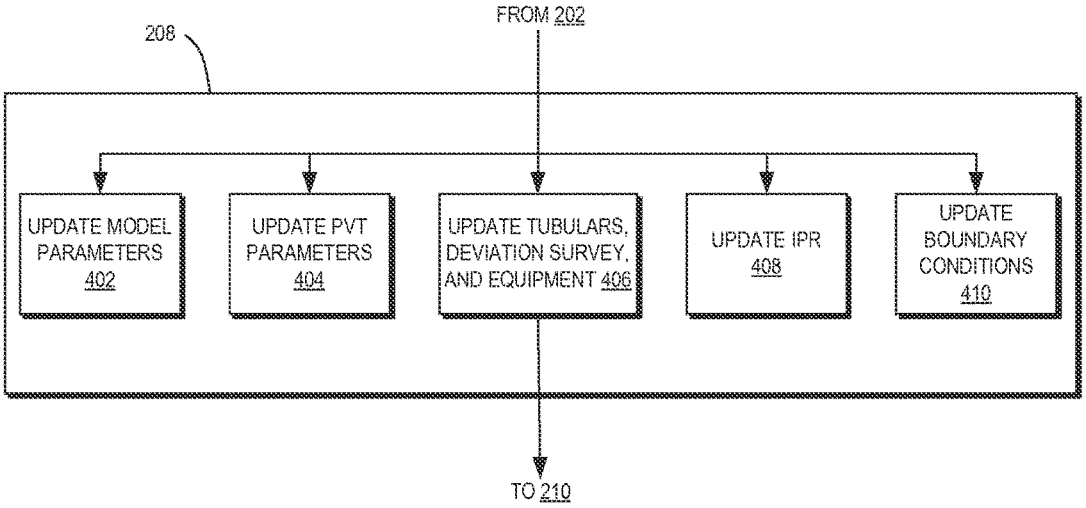
FIG. 4 illustrates a flowchart of updating well model parameters, according to an embodiment.

FIG. 4 illustrates an embodiment of updating the model based on input 208 (also referred to as the "updating process 208"), according to an embodiment. The updating process 208 may including receiving as inputs the latest (e.g. based on the time-stamp) model, as well as the latest test data (e.g., from measurements taken in the physical system). The updating process 208 may then proceed to determining and updating any one or more of the several components of the model. Thus, as shown, the parameters 304, 306, 308, 310, 312 may be updated in the respective boxes 402, 404, 406, 408, 410. Once one, some, or all of the aspects are updated based on the test data, the model may be ready for validation.

Figure 5:
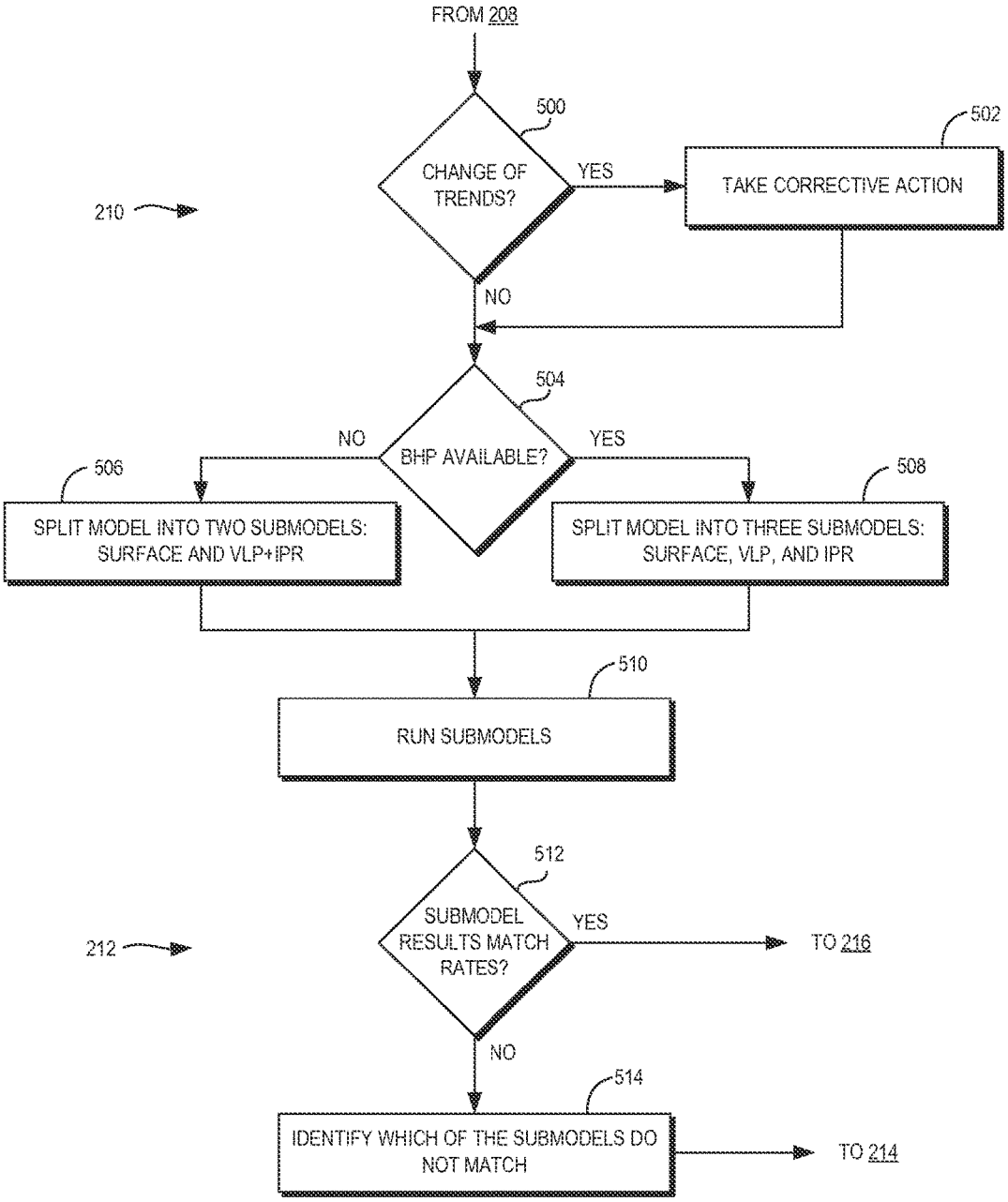
FIG. 5 illustrates a flowchart of validating an updated model and determining whether to calibrate the updated model, according to an embodiment.

Accordingly, referring back to FIG. 2, the method 200 may include validating the model, as at 210 (also be referred to as the "validation process 210"), and determining whether a calibration is called for, as at 212 (also referred to as the "determination process 212"), based on the validation at 210. FIG. 5 illustrates an example of the validation process 210 and the calibration process 212.

The validation process 210 may begin by receiving the model, as updated at 208. The validation process 210 may then include determining whether there has been a change in the trends of the time-dependent variables, as at 500. For example, if the time-dependent variables, or the derivatives, integrals, etc., thereof change beyond a predetermined threshold over a predetermined amount of time, the determination at 500 may be "YES." A "YES" determination at 500 may lead to taking corrective action, as at 502. Such corrective action may include providing a warning to a user of the trend change, which may be an indication that one or more aspects of the model may be recalibrated and/or that any well production prediction rates calculated using the model may be inaccurate.

If the determination is "NO" at 500 or the corrective action has been taken at 502, the validation process 210 may proceed to determining what pressure measurements are available, and then breaking the model into component submodels based on these measurements. The model may be broken down into as many segments as pressure measurements are available. These measurements may be the pressure at the boundaries, and generally include reservoir pressure estimated from build ups, downhole gauges at bottom hole, tubing pressure at the well head, pressure after the choke, flow line pressure, separator pressure, etc. Each component submodel has a pressure reconciliation or agreement between these boundaries, which may allow the submodels to be calibrated. The component submodels may include an IPR model, which generally extends from the reservoir pressure to the bottomhole pressure; a VLP model, which extends from the bottomhole pressure to the tubing head pressure; choke models that start from the tubuing pressure and output pressure downstream of the choke; and flowline models that start after the choke and end at a separator manifold.

Accordingly, in a specific example, as illustrated, the validation process 210 may include determining whether a bottomhole pressure is available, as at 504. If the bottomhole pressure is available (determination at 504 is "YES"), the validation process 210 may proceed to splitting the model into two parts or "submodels," a surface submodel and a vertical lift performance (VLP) and inflow performance relationship (IPR) submodel, as at 506. Alternatively, if the determination at 504 is "YES," the validation process 210 may proceed to splitting the model into three parts: a surface submodel, a vertical lift performance submodel, and an inflow performance relationship submodel, as at 508.

Note, in both cases, the model is split into two or more component parts. These component part submodels may then be simulated or "run" to estimate well parameters over a predetermined duration of time, as at 510. The parameters resulting from the runs may be the "results" of the well simulations according to the submodels.

At this point, in some embodiments, the method 200 may proceed to the determination process 212 (i.e., determining whether calibration is to be conducted). The determination process 212 may result in not only a determination that the model is to be calibrated, but may indicate which of the submodels is to be calibrated, which may shorten the calibration process for a user by narrowing the potential aspects to be adjusted during calibration.

Accordingly, the determination process 212 may include comparing the results of the submodels, and determining whether the model results match liquid production rates. If the rates match (or are within a predetermined threshold), i.e., the determination at 512 is "YES," the determination process 212 may terminate, as calibration may not be called for. The method 200 may thus proceed to saving the model at 218 (see FIG. 2). If the determination at 512 is "NO," the rates do not match (e.g., within a predetermined threshold), the determination process 212 may identify which of the submodels do not match, as at 514, based on the comparison at 512. For example, if the model was split into three submodels, identifying at 514 may determine which of the submodels departs from the other two, or may identify all three, if all three models yield production rates that do not match. If the model was split into two submodels, both submodels may be identified. Once the submodel(s) that do not match are identified at 514, the determination process 212 may conclude, having determined that calibration is called for. The method 200 may then proceed to calibrating at 216.

Figure 6:
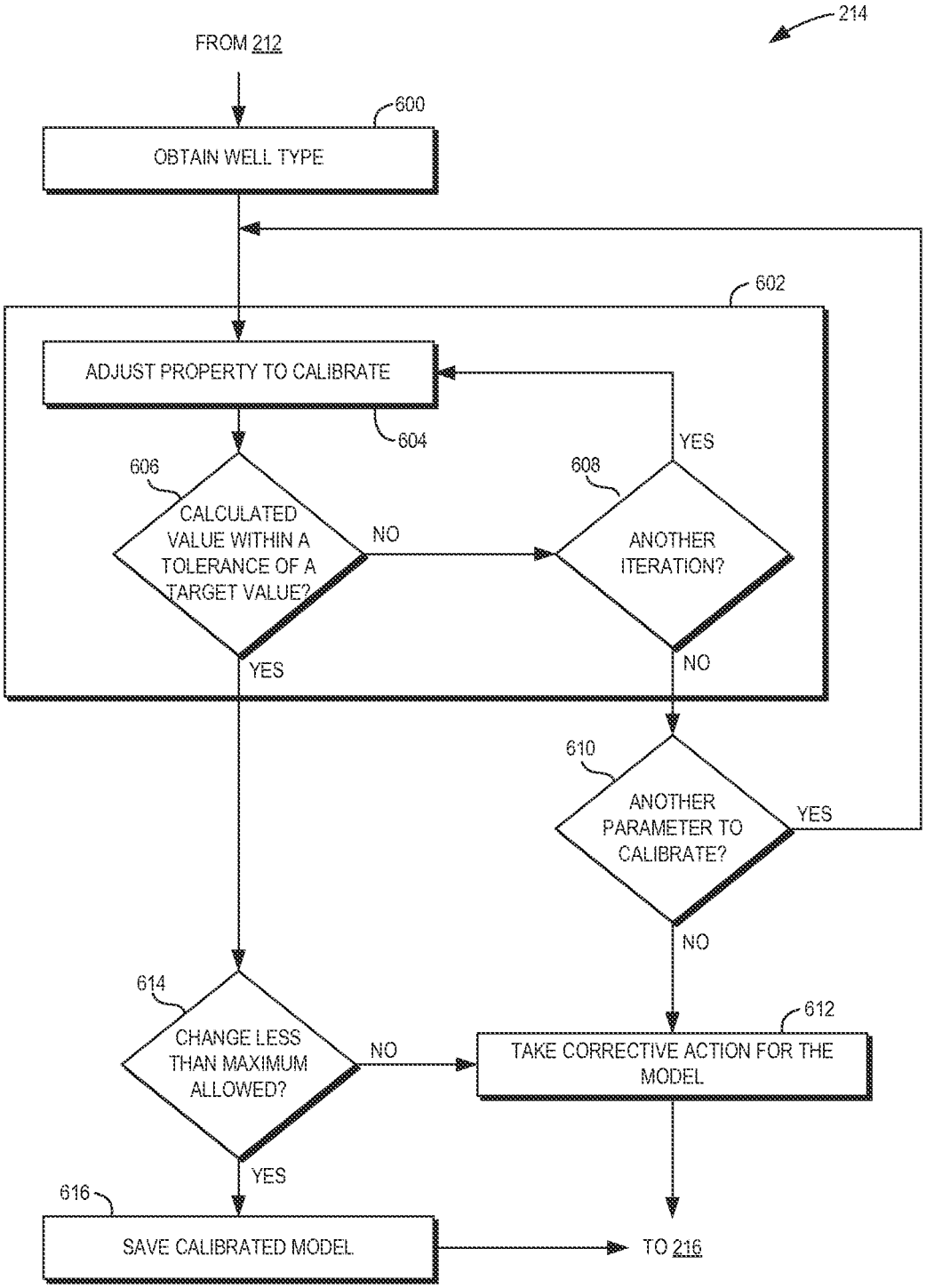
FIG. 6 illustrates a flowchart of calibrating a model, according to an embodiment.

FIG. 6 illustrates a flowchart of calibrating the model at 216 (which may also be referred to as "the calibration process 216"), according to an embodiment. The calibration process 216 may include obtaining a well type, as at 600. Types of wells may include natural flow, gas lift, electric submersible pump (ESP) well, etc. The well type may be a property defined in the model. The calibration settings may be defined in a database, such that users may modify predefined sets of input data, target, and calibration variables.

The calibration process 216 may then proceed to a root-finding process, as at 602. In general, the root-finding process 602 may be configured to determine when the difference between a target variable (based on measurements) and a calculated variable (based on the model) is within a predetermined tolerance, and may employ a bisection root-finding algorithm, or any other suitable algorithm. When the root-finding process 602 does not find a solution within a maximum number of iterations, the next variable may be calibrated. If there are no further variables to calibrate, the root-finding process 602 may flag the model for review.

Target variables generally refer to what is being measured (e.g., pressure). Calculated variables depend on the well type and/or well equipment and user preferences. For example, calculated variables may include productivity index, pump head factor, etc. The method 200 may include referring to a pre-defined list of these variables based on well types, for example, for natural flowing wells, the calculated variable may be productivity index and the target variable may be bottomhole pressure.

Referring to the specific, illustrated embodiment, the root-finding process 602 may proceed to adjusting a property that is selected to be calibrated, as at 604. The amount or way in which a property is adjusted may follow any suitable technique for model calibration. The effect of the adjustment may be determined, e.g., by running all or a portion of the model, and then determining if the calculated variable, i.e., the value for a property (such as production rate) calculated using the adjusted parameter, is within a tolerance (e.g., predetermined) of the target (e.g., as measured), as at 606. In an embodiment, once the calculated variable has been defined, the user may specify a range (minimum and maximum) within which the variables may be adjusted.

If the determination at 606 is "NO," the root-finding process 602 may determine whether to conduct another iteration, as at 608. This may be determined by counting the number of iterations for adjustments to a single parameter, and enforcing a maximum number of iterations, such that the answer at 608 is "YES" if the number of iterations is less than the maximum. In other embodiments, other techniques for controlling the number of iterations may be applied, e.g., different numbers for different adjustments, based on the amount of rate change by an adjustment, etc. If the determination at 608 is "YES," the calibration process 214 may proceed back to adjusting the property being calibrated at 604 and the root-finding process 602 may restart.

If the determination at 610 is "NO," the calibration process 214 may proceed to determining whether to adjust another parameter, as at 610. If additional parameters are still available, the root-finding process 602 may still have an opportunity to be successful, and another parameter may be chosen and adjusted at 604. If there are no further properties to calibrate, the calibration process 214 may proceed to taking corrective action for the model, as at 612, the root-finding process 602 was not successful in calibrating the model. Such corrective action may include displaying a warning to a user, to name one specific example.

If, during the root-finding process 602, the determination at 606 is "YES," the root-finding process 602 may end, and the calibration process 214 may proceed to a history-based, viability-checking process. As at 614, the calibration process 214 may thus determine the deviation of the adjusted variable is larger than a predetermined maximum or "viability threshold." If the difference between the original calibration value and the result of the root-finding process 602 is larger than the viability threshold, the calibration process 214 may also flag the model to be reviewed (or take another corrective action at 612). This may avoid wildly changing one parameter in order to match calibration values.

Once a calibrated model is prepared and saved, it may be employed to predict well production rates based on different variables, which may depend on the type of well and the available measurements. For example, for each well type, a predefined set of input parameters may be received for prediction. For each input parameter, a range may be extracted from historical trends, along with an uncertainty percentage. A multi-dimensional grid may then be generated based on the input parameters and the range. The latest model version may be obtained, and the model may be run for each row of the grid. A proxy model may then be trained, e.g., a neural network or multivariate regression, with the input parameters and the calculated well production rates. The proxy model may then be ready for prediction and optimization.

Figure 7:
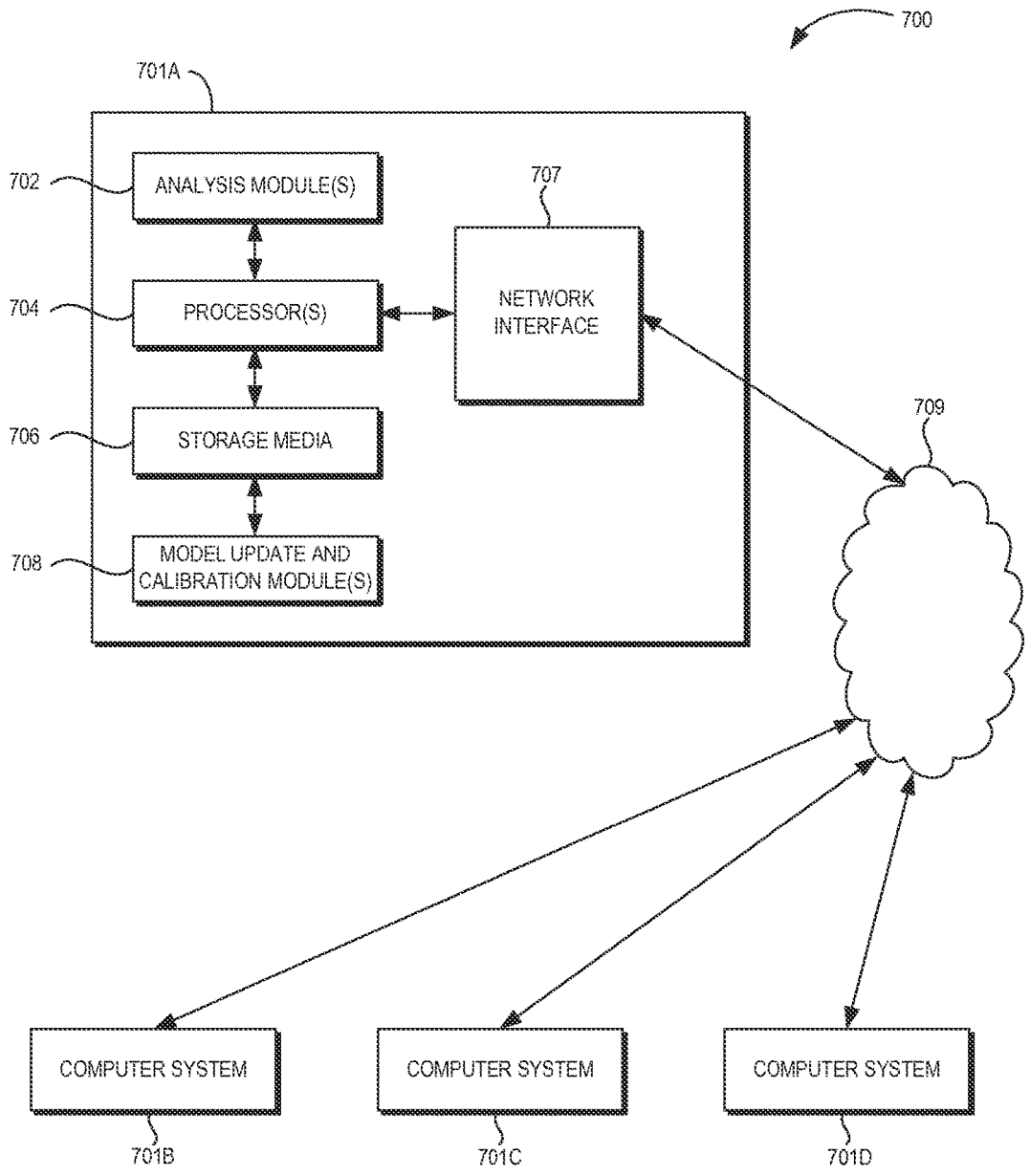
FIG. 7 illustrates a schematic view of a computer system, according to an embodiment.

FIG. 7 illustrates a flowchart of a computing system 700 in accordance with aspects of the present disclosure. In some embodiments, the method 200 of the present disclosure may be executed by the computing system 700, which may be the same or similar to the system previously described herein (e.g., geologic modeling and analysis system 100). FIG. 7 illustrates an example of such a computing system 700, in accordance with some embodiments. The computing system 700 may include a computer or computer system 701A, which may be an individual computer system 701A or an arrangement of distributed computer systems. The computer system 701A can be the same or similar to that previously described herein (e.g., computing device 115). The computer system 701A includes one or more analysis modules 702 (modules 175, model simulation 180, etc.) that are configured to perform various tasks according to some embodiments, such as one or more methods disclosed herein (e.g., process 200 and process 300). To perform these various tasks, the analysis module 702 executes independently, or in coordination with, one or more processors 704, which is (or are) connected to one or more storage media 706. The processor(s) 704 is (or are) also connected to a network interface 707 to allow the computer system 701A to communicate over a data network 709 with one or more additional computer systems and/or computing systems, such as 701B, 701C, and/or 701D (note that computer systems 701B, 701C and/or 701D may or may not share the same architecture as computer system 701A, and may be located in different physical locations, e.g., computer systems 701A and 701B may be located in a processing facility, while in communication with one or more computer systems such as 701C and/or 701D that are located in one or more data centers, and/or located in varying countries on different continents).

A processor may include a microprocessor, microcontroller, processor module or subsystem, programmable integrated circuit, programmable gate array, or another control or computing device. The storage media 706 may be implemented as one or more computer-readable or machine-readable storage media. Note that while in the example embodiment of FIG. 7 storage media 706 is depicted as within computer system 701A, in some embodiments, storage media 706 may be distributed within and/or across multiple internal and/or external enclosures of computing system 701A and/or additional computing systems. Storage media 706 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, computing system 700 contains one or more model updating and calibrating modules 708. In the example of computing system 700, computer system 701A includes the model updating and calibrating modules 708. In some embodiments, a model updating and calibrating module 408 may be used to perform at least some aspects of one or more embodiments of the methods disclosed herein. In alternate embodiments, a plurality of model updating and calibrating modules 408 may be used to perform at least aspects of methods herein.

It should be appreciated that computing system 700 is one example of a computing system, and that computing system 700 may have more or fewer components than shown, may combine additional components not depicted in the example embodiment of FIG. 7, and/or computing system 700 may have a different configuration or arrangement of the components depicted in FIG. 7. The various components shown in FIG. 4 may be implemented in hardware, software, or a combination of hardware and software, including one or more signal processing and/or application specific integrated circuits.

Further, the processing method described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are included within the scope of protection of the present disclosure.

The foregoing description, for purpose of explanation, has been described with reference to specific embodiments. However, the illustrative discussions above are not intended to be exhaustive or to limit the present disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the present disclosure and its practical applications, to thereby enable others skilled in the art to best utilize the present disclosure and various embodiments with various modifications as are suited to the particular use contemplated. Additional information supporting the disclosure is contained in the appendix attached hereto.

It will also be understood that, although the terms first, second, etc. may be used herein to describe various elements, these elements should not be limited by these terms. These terms are used to distinguish one element from another. For example, a first object could be termed a second object, and, similarly, a second object could be termed a first object, without departing from the scope of the present disclosure. The first object and the second object are both objects, respectively, but they are not to be considered the same object.

What is claimed is:

1. A method for maintaining a well production model, comprising:

receiving an update to a parameter of the model of a well;

updating the model based on the update;

splitting the model into at least two submodels after updating the model, wherein the at least two submodels each model a separate parameter of the well, and wherein a pressure reconciliation boundary is defined between two of the at least two submodels, wherein a pressure modeled in the two submodels is the same at the pressure reconciliation boundary;

running the submodels to obtain results, wherein the results comprise production rates forecasted by each of the submodels;

determining that the results obtained by running the submodels do not match;

in response to determining that the results obtained by running the submodels do not match, calibrating the model based on the update; and forecasting a production rate of the well using the updated, calibrated model.

2. The method of claim 1, wherein splitting the model comprises splitting the model into a surface submodel and a combined vertical lift performance and inflow performance relationship submodel.

3. The method of claim 1, wherein splitting the model comprises splitting the model into three submodels comprising a surface submodel, a vertical lift performance submodel, and an inflow performance relationship model.

4. The method of claim 3, wherein determining that the results obtained by running the submodels do not match comprises identifying one of the three submodels that yields results that do not match results of the other two, and wherein calibrating comprises calibrating the one of the three submodels.

5. The method of claim 1, wherein splitting the model comprises:

when a bottomhole pressure of the well is known, splitting the model into a surface submodel and a combined vertical lift performance and inflow performance relationship submodel; and when the bottomhole pressure of the well is unknown, splitting the model into a surface submodel, a vertical lift performance submodel, and an inflow performance relationship model.

6. The method of claim 1, wherein calibrating the model comprises:

obtaining a well type;

performing a root-finding process, the root-finding process comprising:

adjusting an adjusted property of the model;

calculating a calculated value of the model based on the adjusted property;

determining that the calculated value is within a predetermined tolerance of a target value; and determining that the calculated value differs from a previous calculated value by less than a predetermined tolerance.

7. The method of claim 1, wherein the update comprises a change in a time-dependent variable, a change in an event-dependent variable, or both, and wherein updating the model is in response to receiving the update.

8. The method of claim 1, further comprising adjusting an operating parameter of a physical component of the well based on the forecasting.

9. A computing system, comprising:

one or more processors; and a memory system comprising one or more non-transitory computer-readable media storing instructions that, when executed by at least one of the one or more processors, cause the computing system to perform operations, the operations comprising:

receiving an update to a parameter of the model of a well;

updating the model based on the update;

splitting the model into at least two submodels after updating the model, wherein the at least two submodels each model a separate parameter of the well, and wherein a pressure reconciliation boundary is defined between two of the at least two submodels, wherein a pressure modeled in the two submodels is the same at the pressure reconciliation boundary;

running the submodels to obtain results, wherein the results comprise production rates forecasted by each of the submodels;

determining that the results obtained by running the submodels do not match;

in response to determining that the results obtained by running the submodels do not match, calibrating the model based on the update; and forecasting a production rate of the well using the updated, calibrated model.

10. The system of claim 9, wherein splitting the model comprises splitting the model into a surface submodel and a combined vertical lift performance and inflow performance relationship submodel.

11. The system of claim 9, wherein splitting the model comprises splitting the model into three submodels comprising a surface submodel, a vertical lift performance submodel, and an inflow performance relationship model.

12. The system of claim 11, wherein determining that the results obtained by running the submodels do not match comprises identifying one of the three submodels that yields results that do not match results of the other two, and wherein calibrating comprises calibrating the one of the three submodels.

13. The system of claim 9, wherein splitting the model comprises:

when a bottomhole pressure of the well is known, splitting the model into a surface submodel and a combined vertical lift performance and inflow performance relationship submodel; and when the bottomhole pressure of the well is unknown, splitting the model into a surface submodel, a vertical lift performance submodel, and an inflow performance relationship model.

14. The system of claim 9, wherein calibrating the model comprises:

obtaining a well type;

performing a root-finding process, the root-finding process comprising:

adjusting an adjusted property of the model;

calculating a calculated value of the model based on the adjusted property;

determining that the calculated value is within a predetermined tolerance of a target value; and determining that the calculated value differs from a previous calculated value by less than a predetermined tolerance.

15. The system of claim 9, wherein the update comprises a change in a time-dependent variable, a change in an event-dependent variable, or both, and wherein updating the model is in response to receiving the update.

16. The system of claim 9, wherein calibrating the model comprises:

obtaining a well type;

performing a root-finding process, the root-finding process comprising:

adjusting an adjusted property of the model;

calculating a calculated value of the model based on the adjusted property;

determining that the calculated value is within a predetermined tolerance of a target value; and determining that the calculated value differs from a previous calculated value by less than a predetermined tolerance.

17. A non-transitory computer-readable medium storing instructions that, when executed by at least one processor of a computing system, cause the computing system to perform operations, the operations comprising:

receiving an update to a parameter of the model of a well;

updating the model based on the update;

splitting the model into at least two submodels after updating the model, wherein the at least two submodels each model a separate parameter of the well, and wherein a pressure reconciliation boundary is defined between two of the at least two submodels, wherein a pressure modeled in the two submodels is the same at the pressure reconciliation boundary;

running the submodels to obtain results, wherein the results comprise production rates forecasted by each of the submodels;

determining that the results obtained by running the submodels do not match;

in response to determining that the results obtained by running the submodels do not match, calibrating the model based on the update; and forecasting a production rate of the well using the updated, calibrated model.

18. The medium of claim 17, wherein splitting the model comprises splitting the model into a surface submodel and a combined vertical lift performance and inflow performance relationship submodel.

19. The medium of claim 17, wherein splitting the model comprises splitting the model into three submodels comprising a surface submodel, a vertical lift performance submodel, and an inflow performance relationship model.

20. The medium of claim 19, wherein determining that the results obtained by running the submodels do not match comprises identifying one of the three submodels that yields results that do not match results of the other two, and wherein calibrating comprises calibrating the one of the three submodels.

21. The medium of claim 17, wherein splitting the model comprises:

when a bottomhole pressure of the well is known, splitting the model into a surface submodel and a combined vertical lift performance and inflow performance relationship submodel; and when the bottomhole pressure of the well is unknown, splitting the model into a surface submodel, a vertical lift performance submodel, and an inflow performance relationship model.

* * * * *